US007240889B2

(12) United States Patent
Giovinazzi

(10) Patent No.: US 7,240,889 B2
(45) Date of Patent: Jul. 10, 2007

(54) SECURING BRACKET FOR A FLOOR SUPPORTED LAUNDRY APPLIANCE

(76) Inventor: Thomas Giovinazzi, 205 Coari Ave., Minotola, NJ (US) 08341

( * ) Notice: Subject to any disclaimer, the term of this patent is extended or adjusted under 35 U.S.C. 154(b) by 0 days.

(21) Appl. No.: 10/731,491

(22) Filed: Dec. 10, 2003

(65) Prior Publication Data

US 2005/0127265 A1 Jun. 16, 2005

(51) Int. Cl.
*F16M 1/00* (2006.01)

(52) U.S. Cl. ..... 248/501; 248/505; 312/351.1

(58) Field of Classification Search ..... 248/501, 248/500, 680, 681, 505, 507, 154, 673, 677, 248/220.21; 312/351.1
See application file for complete search history.

(56) References Cited

U.S. PATENT DOCUMENTS 302,374 A 7/1884 Baker ..... 267/69
2,847,207 A 8/1958 Chulack et al. ..... 267/71
2,957,667 A 10/1960 Kughler ..... 267/71
4,093,327 A * 6/1978 Linger ..... 312/244
4,270,821 A * 6/1981 Verdesca ..... 312/245
4,473,316 A * 9/1984 Welch ..... 403/246
4,669,695 A * 6/1987 Chou ..... 248/500
4,754,948 A * 7/1988 Casciani ..... 248/680
4,842,095 A 6/1989 Rozek ..... 181/207
5,076,525 A * 12/1991 Whipple ..... 248/300
5,470,042 A * 11/1995 Fietz et al. ..... 248/678
5,954,307 A * 9/1999 Williams ..... 248/501
6,345,874 B2 * 2/2002 Duong et al. ..... 312/351.1
6,533,238 B2 3/2003 Barnes et al. ..... 248/680

* cited by examiner

*Primary Examiner*—Kimberly T. Wood
(74) *Attorney, Agent, or Firm*—Brady, O'Boyle & Gates

(57) ABSTRACT

A securing bracket for a floor supported laundry appliance, such as a washing machine or a clothes dryer. The securing bracket is connected between the rear legs of the appliance and an adjacent wall to prevent skidding of the appliance on the floor. The securing bracket also includes a shock absorber for dampening vibrations transmitted from the appliance to the securing bracket and an attached wall.

7 Claims, 4 Drawing Sheets

SECURING BRACKET FOR A FLOOR SUPPORTED LAUNDRY APPLIANCE

BACKGROUND OF THE INVENTION

Floor supported laundry appliances, such as washing machines and clothes dryers, experience significant vibrations during the spin and tumbling cycles of the machines. At times, these vibrations can cause the machine to skid on the floor away from its original location.

In an attempt to overcome this problem, it has been proposed to provide the supporting legs of the appliance with skid resistant and vibration dampening pads. While these pads initially provide the necessary skid resistance and vibration dampening, they soon become deteriorated and have to be replaced.

It has also been proposed to connect the appliance to a bracket which, in turn, is connected to the floor or adjacent wall. While this arrangement prevents the appliance from skidding, there is no provision for vibration dampening resulting in the floor or wall eventually cracking; thus releasing the bracket secured thereto.

After considerable research and experimentation, the securing bracket of the present invention has been developed which not only prevents skidding of the appliance on the floor but also dampens the vibration transmitted to the securing bracket.

SUMMARY OF THE INVENTION

The laundry appliance securing bracket of the present invention comprises an angle iron positioned on the floor adjacent to the rear of the appliance to be secured. A pair of channel members is adjustably mounted on the base of the angle iron and a pair of transversely extending spring biased J-bars is slidably mounted in the side walls of the channel members. The free end of each J-bar is provided with a hook portion for engaging the rear legs of the appliance. A lag screw extends through an enlarged opening in the vertical arm of the angle iron and is secured into a wall behind the appliance. A latch assembly is pivotally connected to the angle iron arm and is adapted to engage the stem of the lag screw adjacent the screw head to thereby detachably fasten the angle iron to the wall.

By this construction and arrangement, the J-bars not only prevent the appliance from skidding, but they also absorb the vibration of the machine to thereby prevent vibrations from being transmitted to the angle iron and its fixation to the wall. The latch assembly also facilitates the disconnection of the appliance from the wall for repairs or replacement.

DESCRIPTION OF THE PREFERRED EMBODIMENT

Figure 1:
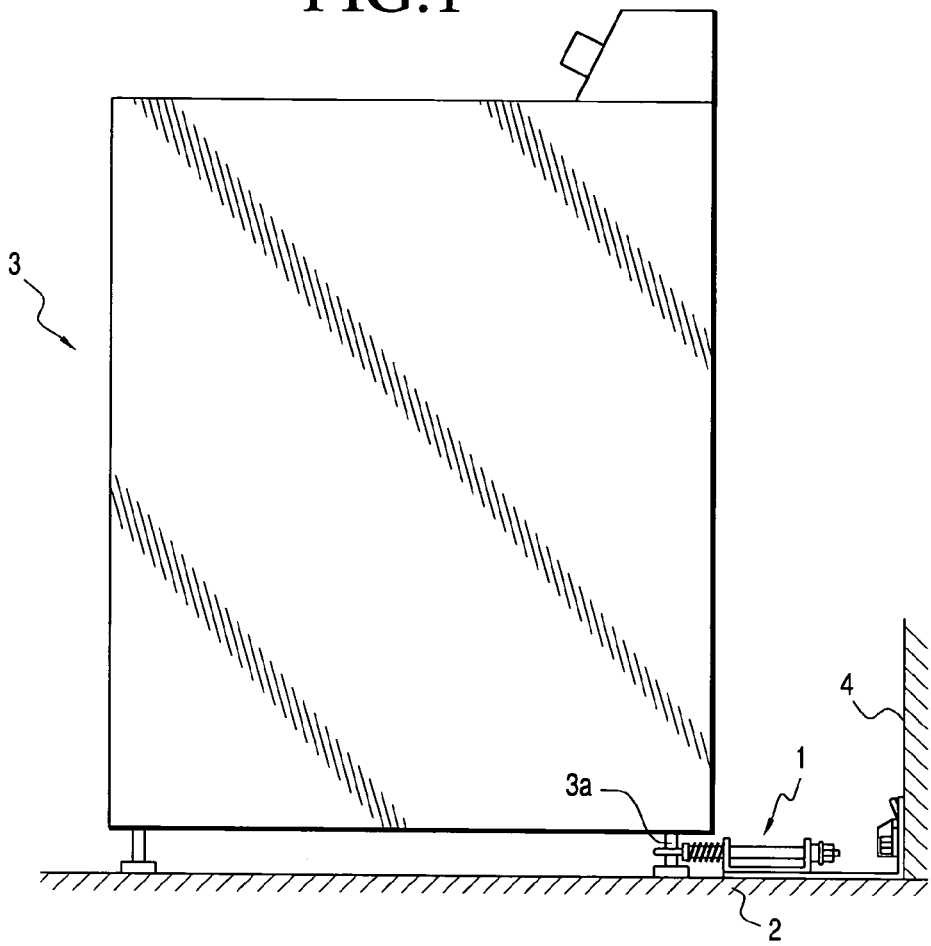
FIG. 1 is a side elevation of the securing bracket of the present invention connecting a laundry appliance to an adjacent wall.
Figure 2:
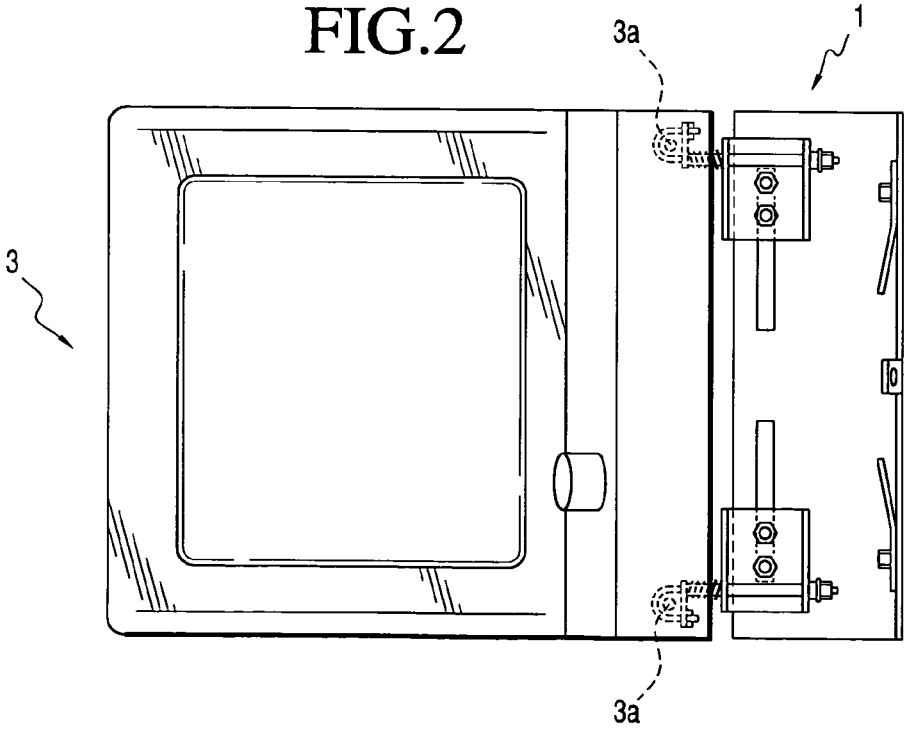
FIG. 2 is a top plan view of the securing bracket and appliance as shown in FIG. 1.

Referring to the drawings and more particularly to FIGS. 1 and 2, the securing bracket 1 of the present invention is positioned on the floor 2 between the rear of a laundry appliance 3, such as a washing machine or dryer, and a wall 4, the bracket being connected to the rear legs 3*a* of the appliance 3 and the wall 4, to be described more fully hereafter.

Figure 3:
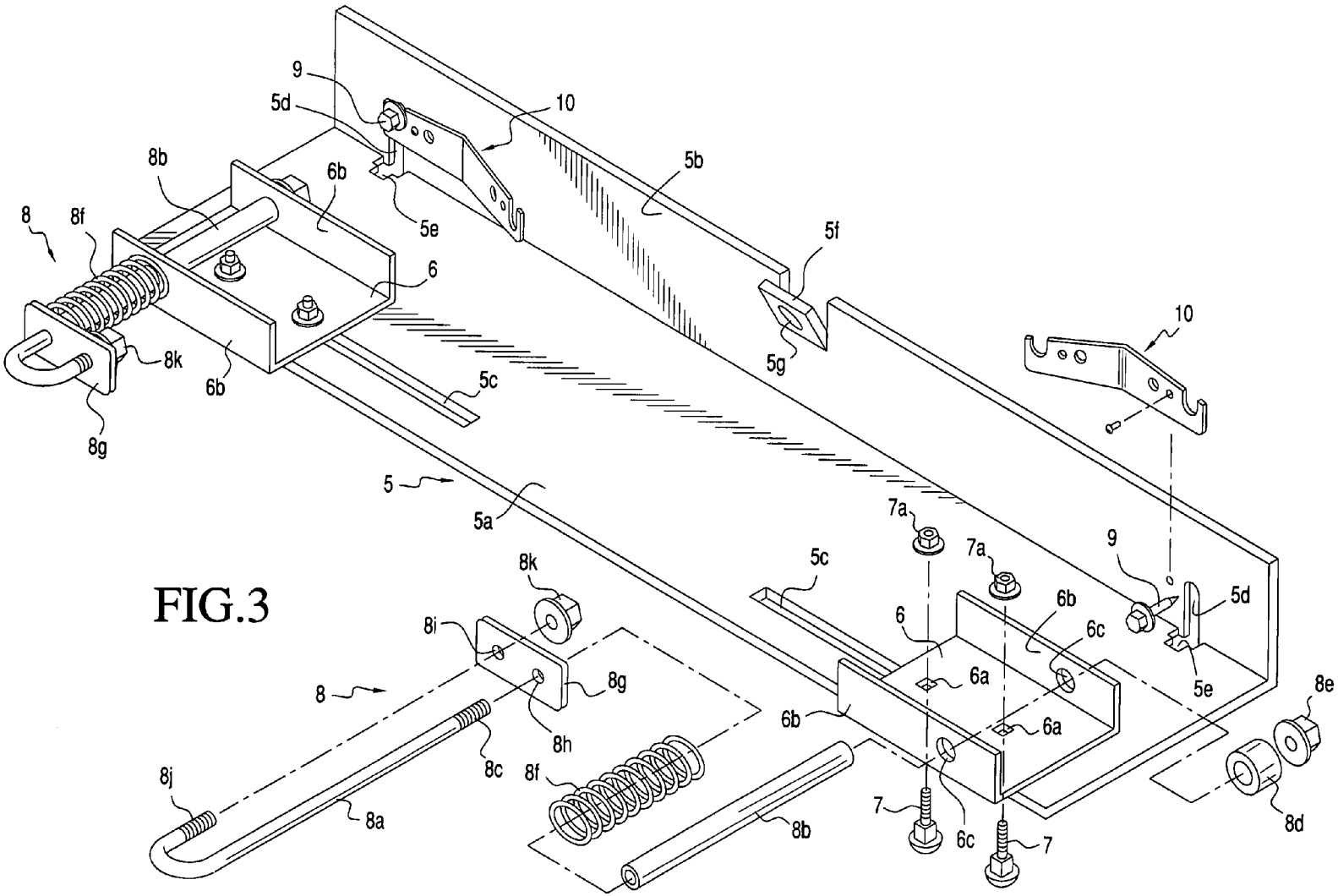
FIG. 3 is an exploded perspective view of the securing bracket of the present invention.
Figure 4:
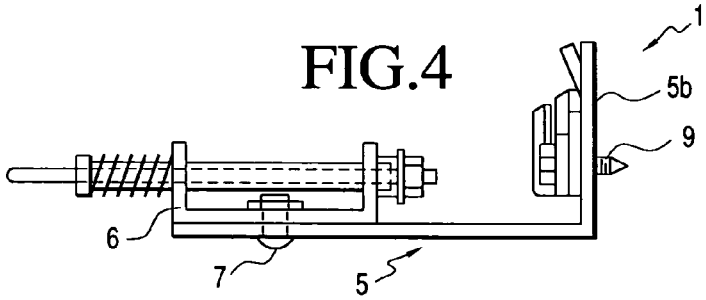
FIG. 4 is a side elevational view of the securing bracket.
Figure 5:
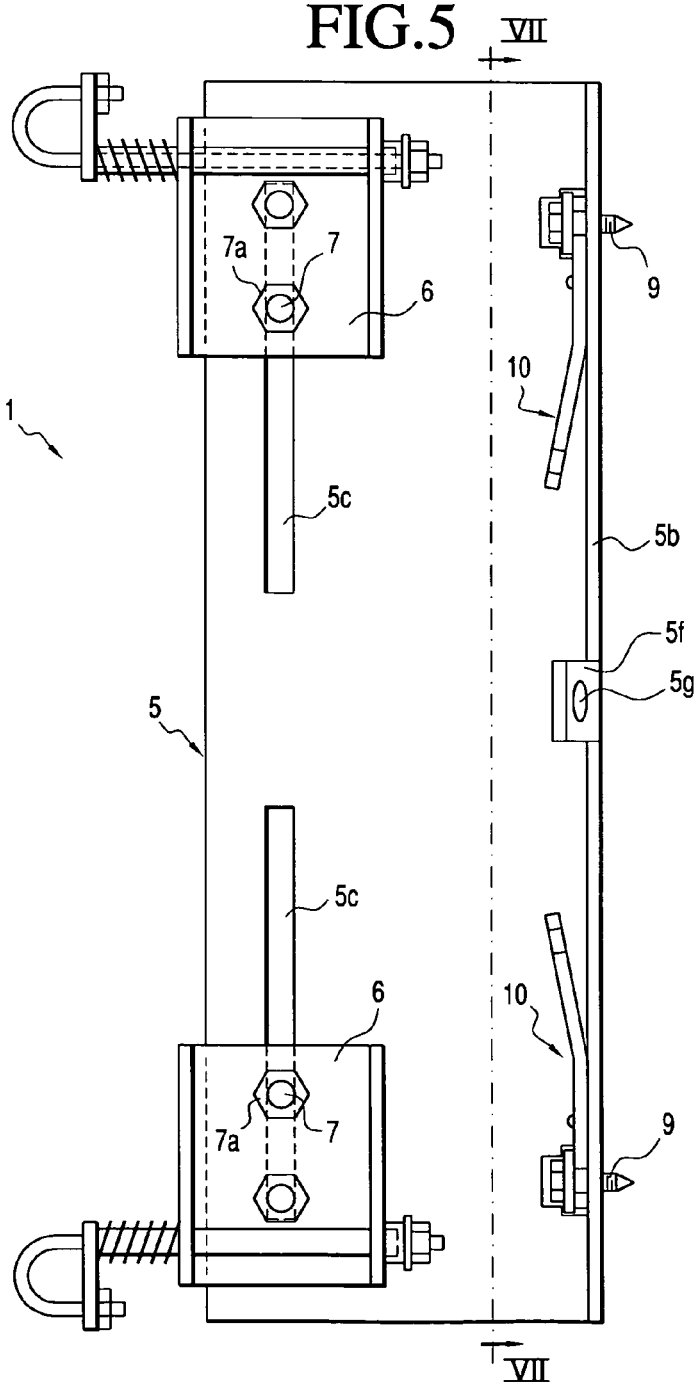
FIG. 5 is a top plan view of the securing bracket.
Figure 6:
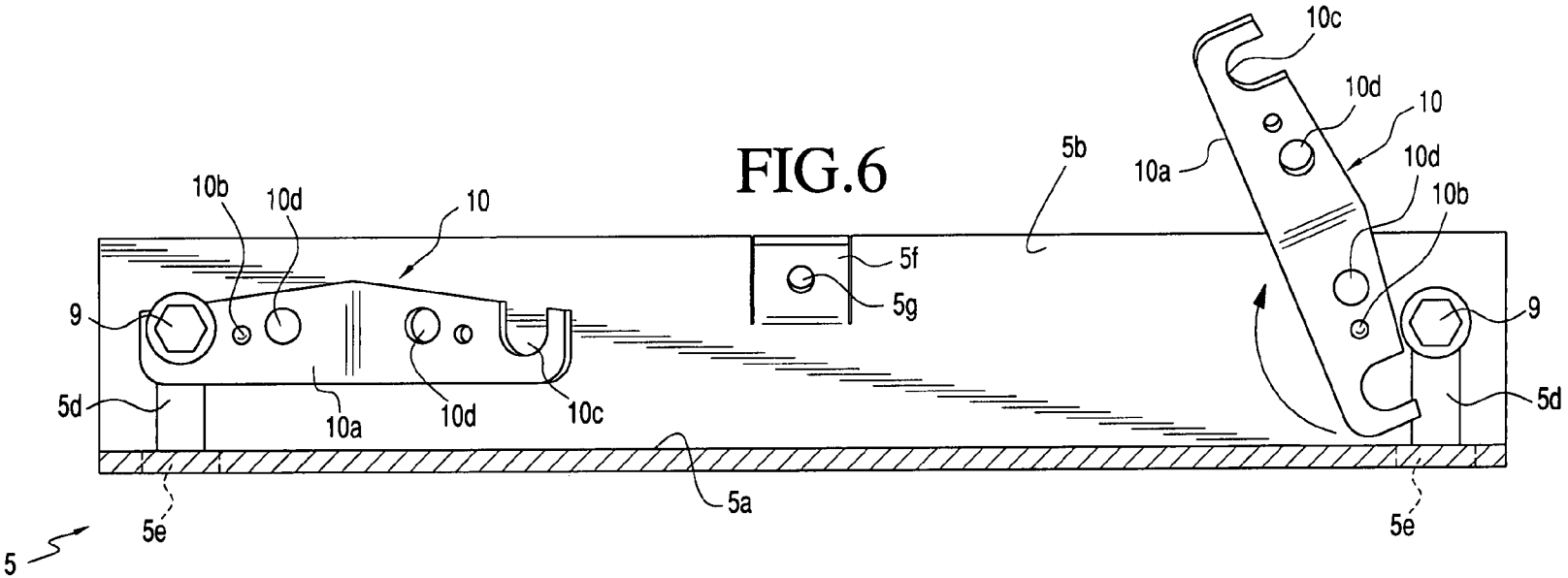
FIG. 6 is a front elevational view, partly in section, showing the vertical arm of the angle iron and associated latching members.
Figure 7:
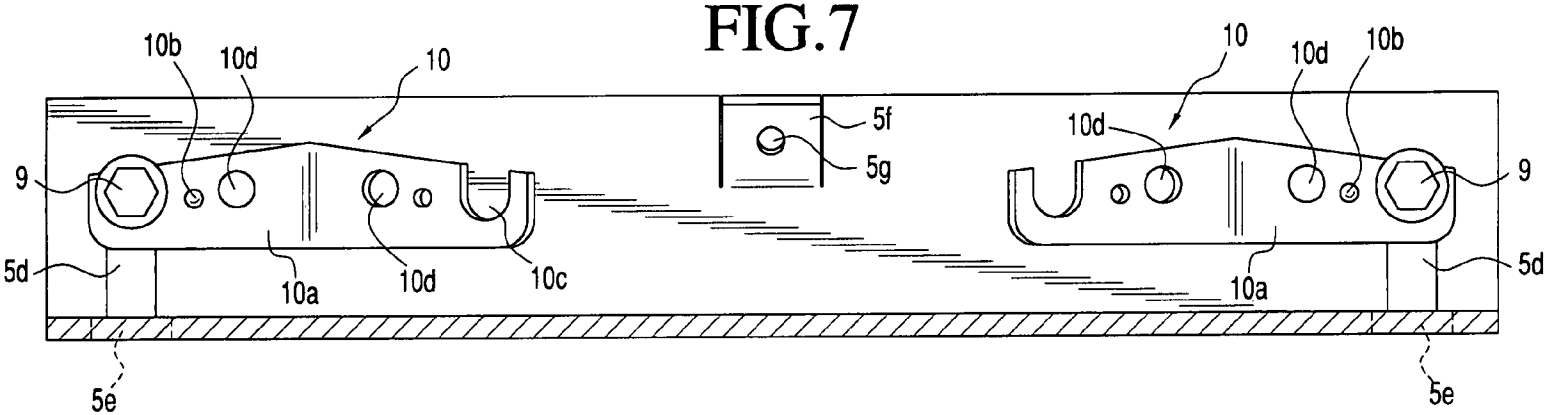
FIG. 7 is a view taken along line VII-VII of FIG. 5.

The details of the construction of the bracket 3 are illustrated in FIGS. 3, 4 and 5, wherein an angle iron 5 is provided having a base portion 5*a* and a vertical arm 5*b*. The base portion 5*a* is provided with a pair of longitudinally spaced slots 5*c* upon which channel members 6 are positioned and secured thereon by carriage bolts 7 extending upwardly through the slots 5*c* and square holes 6*a* provided in the base or web of the channels 6, the channels 6 being secured in place by lock washer-nuts 7*a* threaded onto the bolts 7.

Each of the channels 6 is provided with a J-bar assembly 8 comprising a bolt portion 8*a* extending through a tube 8*b* positioned within the channel 6 between the vertical walls 6*b* of the channel 6 and aligned with apertures 6*c* provided in the channel walls 6*b*. The end of the bolt portion 8*a* is threaded as at 8*c* upon which a bushing 8*d* is mounted and a lock nut 8*e* is threaded. By this construction and arrangement, the bolt portion 8*a* is slidably mounted in the tube 8*b*. A coil spring 8*f* is mounted on the bolt portion 8*a* coaxial therewith and is biased between the exterior surface of the channel side wall 6*b* and a plate 8*g* having a pair of apertures 8*h* and 8*i* for slidably receiving the bolt portion 8*a* and the threaded end 8*j* of the hook portion of the J-bar 8, respectively. The plate 8*g* is secured to the J-bar 8 by a lock nut 8*k* threaded onto the end portion 8*j*.

As will be seen in FIGS. 1, 3, 6 and 7, the angle iron 5 is detachably secured to an adjacent wall 4 by means of a pair of lag screws 9 extending through elongated vertical slots 5*d* provided in the vertical wall 5*b* of the angle iron 5, and into the wall 4. The vertical slots 5*d* communicate with enlarged openings 5*e* in the base portion 5*a* of the angle iron 5.

A latch assembly 10 cooperates with the lag screws 9 for releasably securing the angle iron 5 to the wall 4 and comprises a pair of latch plates 10*a* pivotally connected, as at 10*b*, to the angle iron vertical wall 5*b*. Each latch plate 10*a* is provided with an arcuate slot 10*c* at each end thereof for receiving the stem portions of the screws 9. By this construction and arrangement, the latch plates 10*a* can be pivoted in one direction to release the latch plates 10*a* from the lag screws 9 and in the opposite direction to connect the latch plates 10*a* to the screws 9.

Tool receiving apertures 10*d* are provided in the latch plates 10*a* adapted to receive the hooked end of a tool, such as a length of wire (not shown), which is inserted downwardly in the space between the back of the appliance 3 and wall 4, whereby the latch plates 10*a* can be pivoted from a remote location.

The angle iron vertical wall 5*b* is provided with a tab 5*f* having an aperture 5*g* adapted to receive the hook portion of a tool (not shown), whereby the angle iron 5 and associated latch assembly 10 can be lifted off the screws 9 wherein the screw stems and heads pass through the slots 5*d* in the angle iron vertical wall 5*b* and the apertures 5*e* in the angle iron base 5*a*, whereby the securing bracket 1 is disconnected from the wall 4.

To secure the appliance 3 to the wall 4, the angle iron 5 is secured to the wall 4 by inserting the lag screws 9 through the slots 5*d* in the angle iron vertical wall 5*b*. The channels 6 and associated J-bar assemblies 8 are slid on the angle iron base portion 5*a* to position them for proper alignment with the two rear legs 3*a* of the appliance 3. The hook portions of the J-bars 8 are positioned around the appliance legs 3*a* and the plates 8*g* are then secured to the ends of the J-bars 8 by the lock nuts 8*k*.

During the operation of the appliance 3, vibrations therefrom are transmitted to the J-bar assemblies slidably mounted in the channels 6 and absorbed by the springs 8*f*.

From the above description, it will be appreciated by those skilled in the art that the securing bracket 1 of the present invention is an improvement over heretofore employed skid resistant and vibration dampening pads and other securing brackets.

It is to be understood that the form of the invention herewith shown and described is to be taken as a preferred example of the same, and that various changes in the shape, size and arrangement of parts may be resorted to, without departing from, the spirit of the invention or scope of the subjoined claims.

I claim:

1. The combination of a securing bracket and a floor supported laundry appliance, said securing bracket comprising an angle iron having a base portion and a vertical arm, the base portion of the angle iron being positioned on the floor behind the appliance and in proximity to a pair of rear legs on the appliance, a lag screw extending through a slot provided in the vertical arm of said angle iron and into a wall in proximity to the rear of the appliance, an enlarged opening in said base portion of said angle iron communicating with said slot, shock absorber means connected between the rear legs of the appliance and the angle iron, whereby skidding of the appliance on the floor is prevented and vibrations from the appliance are dampened, and a latch assembly connected to the vertical arm of the angle iron engaging the lag screw, whereby the angle iron is detachably connected to the wall.

2. The combination of a securing bracket and a laundry appliance according to claim 1, wherein the latch assembly comprises a plate pivotably connected to the vertical arm of the angle iron and a slot provided in the plate for receiving the stem portion of the lag screw, to thereby secure the angle iron to the wall, whereby when the plate is pivoted in a direction away from the lag screw, the angle iron is detached from the wall and movable away therefrom by lifting the angle iron up from the floor to thereby allow the lag screw stem to slide through the slot in the vertical arm of the bracket allowing the lag screw head to pass through the enlarged opening in the base portion.

3. The combination of a securing bracket and a floor supported laundry appliance, said securing bracket comprising an angle iron having a base portion and a vertical arm, the base portion of the angle iron being positioned on the floor behind the appliance and in proximity to a pair of rear legs on the appliance, a lag screw extending through a slot provided in the vertical arm of said angle iron and into a wall in proximity to the rear of the appliance, an enlarged opening in said base portion communicating with said slot, and shock absorber means connected between the rear legs of the appliance and the angle iron, whereby skidding of the appliance on the floor is prevented and vibrations from the appliance are dampened wherein the shock absorber means comprises a pair of longitudinally spaced channels positioned on the base portion of the angle iron, each channel having a pair of vertical walls integral with a web portion, adjustment means connected between the base portion and each channel for adjusting the space between the channels to align each channel with a respective rear leg on the appliance, a pair of J-bars, each J-bar having a bolt portion and a hook portion, aligned apertures in the vertical walls of each channel, the bolt portion of each J-bar extending through said aligned apertures in a respective channel and being slidably mounted therein, the hook portion of each J-bar being connected to a respective rear leg on the appliance, a plate connected to each hook portion of each J-bar, and a coil spring mounted on the bolt portion of each J-bar coaxial therewith and biased between the plate and a vertical wall of a respective channel, whereby the vibrations of the appliance are absorbed by the compression and expansion of the coil springs during the reciprocatory sliding movement of the J-bar bolt portions in the channels.

4. The combination of a securing bracket and a laundry appliance according to claim 3, wherein the channel adjustment means comprises a pair of longitudinally spaced slots provided in the base portion of the angle iron, a pair of apertures in the web portion of each channel aligned with a respective slot in the angle iron base portion, and bolt and nut assemblies extending through the slots and apertures for securing the channels at an adjusted position.

5. The combination of a securing bracket and a laundry appliance according to claim 3, wherein a tube is positioned within each channel aligned with the apertures in the channel walls, the bolt portion of each J-bar being slidably mounted in a respective tube.

6. The combination of a securing bracket and a laundry appliance according to claim 2, wherein an aperture is provided in the latch plate adapted to receive the hooked end of a tool, whereby the plate can be pivoted from a remote location.

7. The combination of a securing bracket and a laundry appliance according to claim 6, wherein an aperture is provided in the vertical arm of the angle iron adapted to receive the hooked end of a tool, whereby the angle iron can be lifted off the lag screw.

* * * * *